US009714469B2

(12) United States Patent
Portet et al.

(10) Patent No.: US 9,714,469 B2
(45) Date of Patent: Jul. 25, 2017

(54) COMPOSITION FOR INCREASING THE LIPOPHOBICITY OF A WATCH-MAKING COMPONENT

(75) Inventors: David Portet, Briollay (FR); Gregory Lecollinet, Juvardeil (FR)

(73) Assignee: Rolex SA, Geneva (CH)

( * ) Notice: Subject to any disclaimer, the term of this patent is extended or adjusted under 35 U.S.C. 154(b) by 0 days.

(21) Appl. No.: 13/996,634

(22) PCT Filed: Dec. 21, 2011

(86) PCT No.: PCT/EP2011/073657

§ 371 (c)(1),
(2), (4) Date: Jun. 21, 2013

(87) PCT Pub. No.: WO2012/085130

PCT Pub. Date: Jun. 28, 2012

(65) Prior Publication Data

US 2013/0287955 A1 Oct. 31, 2013

(30) Foreign Application Priority Data

Dec. 23, 2010 (EP) ..... 10306507

(51) Int. Cl.
*C23C 22/02* (2006.01)
*C10M 105/04* (2006.01)
(Continued)

(52) U.S. Cl.
CPC ..... *C23C 22/02* (2013.01); *C10M 105/04* (2013.01); *C10M 107/00* (2013.01); *C10M 111/04* (2013.01); *C23C 22/03* (2013.01); *G04B 31/08* (2013.01); *C10M 2219/081* (2013.01); *C10M 2219/082* (2013.01); *C10M 2219/09* (2013.01);
(Continued)

(58) Field of Classification Search
USPC ..... 427/318
See application file for complete search history.

(56) References Cited

U.S. PATENT DOCUMENTS

2010/0068553 A1* 3/2010 Tosatti et al. ..... 428/624
2010/0143741 A1 6/2010 Bell et al.

FOREIGN PATENT DOCUMENTS

FR WO2008017721 * 2/2008
WO WO 2008/017721 2/2008
(Continued)

OTHER PUBLICATIONS

Tillwich, "Synthetic lubricants in precision mechanisms—an overview," Journal of Synthetic Lubrication, pp. 91-104, Jul. 1, 1988.
(Continued)

*Primary Examiner* — Nathan T Leong
(74) *Attorney, Agent, or Firm* — Foley & Lardner LLP

(57) ABSTRACT

The present invention describes the highly advantageous properties of a mixture of thiol-perfluoropolyether (PFPE) molecules with perfluorinated bisphosphonic (PF-BP) compounds. This mixture makes it possible in effect to obtain a lipophobic behavior (also referred to as "epilame" effect) with common watch-making lubricants on all the materials tested, including metals, inter alia gold and alloys thereof, ceramics and semiconductors, and gives the surface treated a good resistance to ageing and to cleaning products.

22 Claims, 3 Drawing Sheets

1.1

1.2

1.3

1.4

1.5

(51) Int. Cl.

| | |
|---|---|
| ***C10M 107/00*** | (2006.01) |
| ***C10M 111/04*** | (2006.01) |
| ***G04B 31/08*** | (2006.01) |
| ***C23C 22/03*** | (2006.01) |

(52) U.S. Cl.
CPC . *C10M 2223/06* (2013.01); *C10M 2223/0603* (2013.01); *C10N 2230/06* (2013.01); *C10N 2240/06* (2013.01); *C10N 2250/121* (2013.01); *C10N 2280/00* (2013.01)

(56) References Cited

FOREIGN PATENT DOCUMENTS

| | | | |
|---|---|---|---|
| WO | WO 2008/064513 | | 6/2008 |
| WO | WO2010068535 | * | 6/2010 |

OTHER PUBLICATIONS

International Search Report issued in application No. PCT/EP2011/073657 on Mar. 16, 2012.

Shi et al., "The recovery of fine gold particles from a slurry of minerals using liquid carbon dioxide," Journal of Supercritical Fluids, vol. 17, pp. 81-90, 2000.

Lecollinet et al., "Self-Assembled Monolayers of Bisphosphonates: Influence of Side Chain Steric Hindrance," Langmuir, vol. 25, No. 14, pp. 7828-7835, 2009.

Bonard, "Detection et cartographie de couches d'epilame," Congres International de Chromometrie, pp. 103-108, Sep. 30-Oct. 1, 2004.

Bain et al., "Formation of Monolayer Films by theSpontaneous Assembly of Organic Thiols from Solution onto Gold," J. Am. Chem. Soc., vol. 111, pp. 321-335, 1989.

Folkers et al., "Self-Assembled Monolayers of Long-Chain Hydroxamic Acides on the Native Oxides of Metals," Langmuir, vol. 11, pp. 813-824, 1995.

Massin, "Epilames et Lubrifiants Associes a Haute Stabilte Proprietes, Technologie d'Application Resultats en Horlogerie," Actes du congress des Societes Allemande et Francaise de Chromometrie, pp. 85-93.

Osowiecki, "Un nouvel epilame resitant aux lavages," Bulletin de la Societe de Chronometrie, p. 734-737, 1957.

Renaud et al., "Etats de surface et etalement des huiles d'horlogerie," Bulletin de la Societe de Chronometrie, pp. 681-696, 1956.

* cited by examiner

I.1

I.2

I.3

I.4

I.5

I.6

II.1

II.2

II.3

II.4

II.5

COMPOSITION FOR INCREASING THE LIPOPHOBICITY OF A WATCH-MAKING COMPONENT

The present invention describes the highly advantageous properties of a mixture of thiol-perfluoropolyether (PFPE) molecules with perfluorinated bisphosphonic (PF-BP) compounds. As a matter of fact, this mixture enables to obtain lipophobic behaviour (also referred to as "epilame" effect) with common watch-making lubricants in all the materials tested, including metals, among others gold and alloys thereof, ceramics and semi-conductors, and gives the treated surface good resistance to ageing and to cleaning products.

PRIOR ART

Epilame treatment of watch mechanisms is a surface treatment that prevents the spread of greasy watch lubricants (such as oils or fats) on watch parts (metallic, ceramic and/or semi-conductor surfaces). More generally, it relates to increasing the lipophobicity, in other words reducing the surface energy of surfaces to oils or fats, by recoating said surfaces, for example with a single layer consisting of alkyl-thiol or a fluoropolymer [J M Bonard, CIC acts 2004, pp. 131].

Thiol molecules having the general formula $H(CH_2)_nSH$ can form self-assembled layers on gold (Bain C. D. et al, *J. Am. Chem. Soc* 1989) because the sulphur atoms bind to the metal surface while the alkyl chains point to the other side, aligning and arranging in an uniform geometric pattern on the surface (leading to the formation of "self-assembled" mono layers). These monolayers have alkyl molecules on their surface which confer a degree of hydrophobicity. However, a major drawback to their use is their odour. Moreover, the self-assembled layers consisting of perfluoroalkyl thiols often have low temperature resistance and low resistance to oxidising and reducing products (C. Shi et al, *J. Supercriti. Fluids* 2000).

In addition, the functionalisation of surfaces with fluorinated polymers has the major disadvantage of requiring the use of perfluorinated solvents whose use is controlled by extremely strict regulations and is therefore problematic.

The present Inventors have therefore sought to develop an easy to use composition to increase the epilame effect in an effective and permanent manner on the surfaces of watch components. Ideally, this composition is free of fluorinated or perfluorinated solvents.

In this regard, it is known that bisphosphonate compounds, especially bisphosphonic compounds with a perfluorinated group (BP-PF) or perfluoropolyether (BP-PFPE), modify wetting properties and make the surfaces they cover hydrophobic and lipophobic (FR 2904784 and EP 2054165). The solvents used to deposit these molecules are conventional industrial organic solvents such as alcohol solvents, aldehydes, ketones, ethers, etc. These compounds are capable of binding to self-assembled single layers on metallic materials such as iron, titanium, copper, aluminium, nickel, tin or to metal alloys (for example steel, stainless steel, brass, nickel silver, bronze, tin-nickel, nickel-phosphorus, copper-beryllium).

However, the affinity of BP for some metal or mineral surfaces as well as for various oxides or alloys is limited (Folkers et al, *Langruir*, (1995) 11, 813-824). In addition, due to their low degree of oxidation, gold and silver are not compatible with permanent binding of the layers of PF and PFPE bisphosphonic compounds. However, watch mechanisms can contain components made up of these materials and it is therefore important that the composition of the invention can be used to functionalise surfaces comprised of any metal, including gold and silver, as well as any ceramic or semi-conductor.

The present Inventors have therefore developed, for the first time, an easy to use composition (i.e. containing an organic, non-fluorinated solvent) making it possible to avoid the spread of watch lubricants in an effective and permanent manner on surfaces comprised of any metal whatsoever (including gold), ceramic material or semi-conductor material.

Surprisingly, the composition of the invention increases the lipophobicity of treated surfaces to lubricants conventionally used in watch-making at the same time as conferring very good resistance to products used to clean watch-making components.

SUMMARY OF THE INVENTION

A first aspect of the invention concerns the use, in order to increase the lipophobicity of a surface used in watch-making or jewelry, of a composition comprising at least one thiol compound and at least one bisphosphonic compound or salts thereof, characterised in that said thiol compound has the formula:

HS-A-B—C

Wherein:

A is a $(CH_2)_m$—X— group, m being an integer between 0 and 100, and X being a saturated or unsaturated $C_0$-$C_{100}$ alkyl group, perfluorinated or partially fluorinated, the alkyl chain possibly being substituted or interrupted by 0 to 10 cycloalkyl or aryl groups that may be perfluorinated or not;

B is a) a single chemical bond, or an O, S atom or an S(CO), (CO)S or NR, (CO)NR, NR(CO) group, R being a hydrogen atom or a $C_1$-$C_{10}$ alkyl, or b)

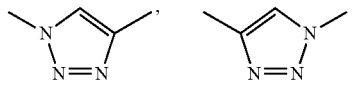

and

C is chosen from among: $F(CF(CF_3)CF_2O)_nCF(CF_3)$—, $F(CF_2CF(CF_3)O)_nCF_2CF_2$—, $F(CF_2CF_2CF_2O)_nCF_2CF_2$—, and $F(CF_2CF_2O)_nCF_2$—, and $C_pF_{2p+1}$—, wherein n and p are integers between 1 and 100, and characterised in that said bisphosphonic compound has the formula:

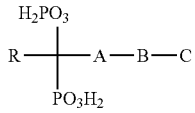

Wherein:

R is a hydrogen atom H or an OH group,

A is a $(CH_2)_m$—X group, m being an integer between 0 and 100, and X being a saturated or unsaturated $C_0$-$C_{100}$ alkyl group, perfluorinated or partially fluorinated, the alkyl chain possibly being substituted or interrupted by 0 to 10 cycloalkyl or aryl groups that may be perfluorinated or not;

B is a) a single chemical bond, or an O, S atom or an S(CO), (CO)S or NR, (CO)NR, NR(CO) group, R being a hydrogen atom or a $C_1$-$C_{10}$ alkyl, or b)

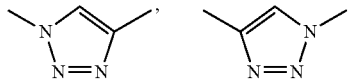

and

C is chosen from among: $(CF(CF_3)CF_2O)_nCF(CF_3)$—, $F(CF_2CF(CF_3)O)_nCF_2CF_2$—, $F(CF_2CF_2CF_2O)_nCF_2CF_2$—, $F(CF_2CF_2O)_nCF_2$ and $C_pF_{2p+1}$—, wherein n and p are integers between 1 and 100.

This composition enables to limit the spread of greasy lubricants (oils or fat) and/or to increase the epilame effect in surfaces used in watch-making or jewelry, for example any surface composed of more than 50%:

Noble metals selected from gold, platinum, silver and copper,

Oxidised metals selected among iron, titanium, aluminium, nickel, ruthenium, rhodium and tin, Alloys selected from steel, stainless steel, brass, nickel-silver, bronze, tin-nickel, nickel-phosphorus, copper-beryllium, palladium-nickel, copper-cobalt, or alloys containing vanadium, chromium, manganese, zinc, tungsten or zirconium, or an alloy with an amorphous crystalline structure, or ceramics and glass (ruby, sapphire, alumina, zircon, silica, quartz) or Semi-conductors such as silicon or germanium and their oxides, or even diamond.

Preferably, said thiol compound is a perfluorinated thiol of the following formula I:

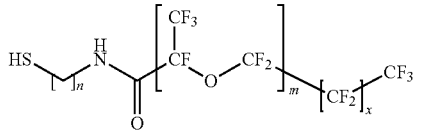

wherein: n is an integer from 1 to 100, m is an integer from 1 to 100 and x is an integer between 1 and 10, and said bisphosphonic compound is a perfluorinated bisphosphonic of following formula II:

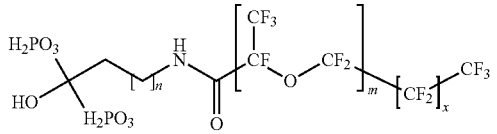

wherein: n is an integer between 1 and 100, m is an integer between 1 and 100, and x is an integer between 1 and 10.

Even more preferably, said perfluorinated thiol compound is a compound of formula I wherein n=6, m=4, and x=1, or n=2, m=4 and x=1, or n=6, m=5 and x=1, or n=2, m=5 and x=1, and said perfluorinated bisphosphonic compound is a compound of formula II wherein n=4, m=4, and x=1.

In a particular embodiment of the invention, said bisphosphonic compounds and said thiol compounds are dissolved in an organic solvent chosen from alcoholic solvents, especially $C_1$ to $C_6$ alcohols such as isopropanol, ethanol, methanol, aldehydes, ketones such as acetone, ethers such as diethyl ether or tetrahydrofuran or alkanes, in particular $C_1$ to $C_8$ alkanes as well as mixtures thereof.

In a second aspect, the present invention also covers a method for coating a surface used in watch-making or jewelry with a functionalization molecular layer, characterised in that it comprises at least the following steps:

a) optionally degreasing the surface by washing with a solvent and then drying, b) optionally oxidising the surface so as to create hydroxyl groups at the surface of the substrate, c) contacting the surface with the composition of the invention, up to the point of self-assembly of thiol and/or bisphosphonic compounds in a single layer coating said surface, d) removing the supernatant, e) optionally dehydrating the surface thus coated, f) rinsing the functionalised surface, g) drying the functionalised surface.

In a third aspect, the present invention covers the use of a functionalised surface obtained from the method defined above in mechanical pieces for watches or jewelry.

Finally, the present invention covers the use, to increase the lipophobicity of a surface for use in watch-making or jewelry or to increase the epilame effect on a surface, of a composition containing a thiol compound of formula I.3 (as the sole active agent):

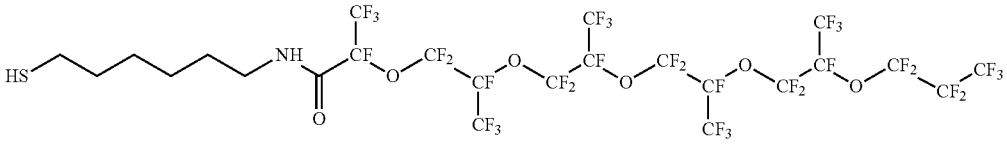

In a particular embodiment, said surface is a metal surface comprised of more than 50% of a noble metal selected from gold, silver, copper and the compound of formula I.3 is dissolved in isopropanol or in a solvent consisting of hydrotreated naphthas.

KEY TO THE FIGURES

DETAILED DESCRIPTION OF THE INVENTION

Figure 1:
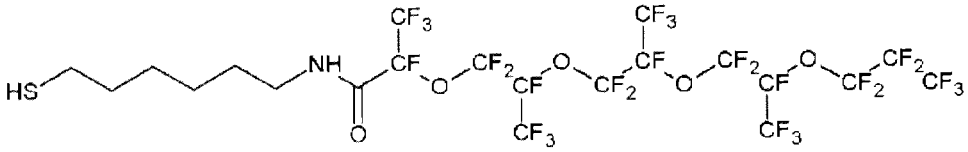
FIG. 1 shows the thiol compound-PF (I.5) and PFPE-thiols (I.1 to I.4 and I.6) of formula I according to the invention.
Figure 1:
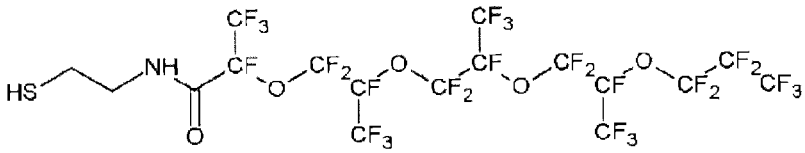
Figure 1:
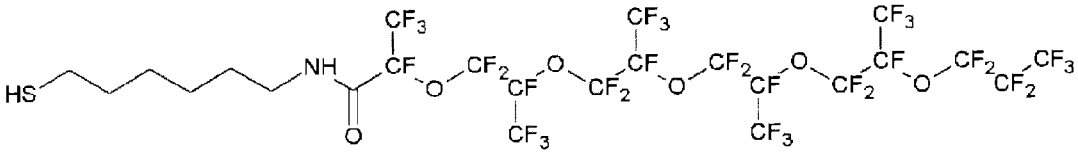
Figure 1:
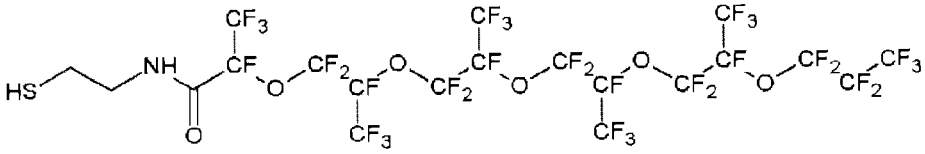
Figure 1:
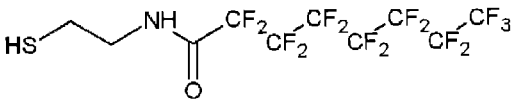
Figure 1:
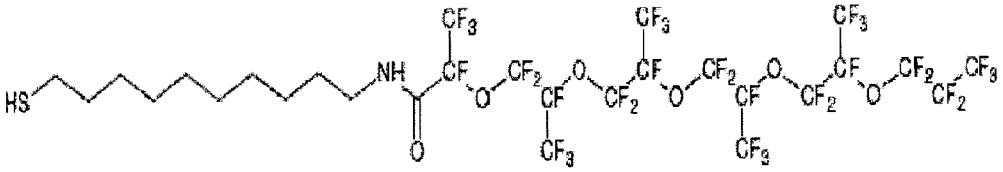
Figure 2:
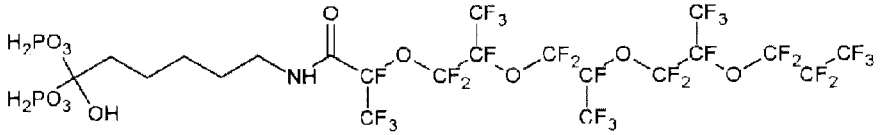
FIG. 2 shows examples of BP-PF and BP-PFPE molecules of formula II according to the invention.
Figure 2:
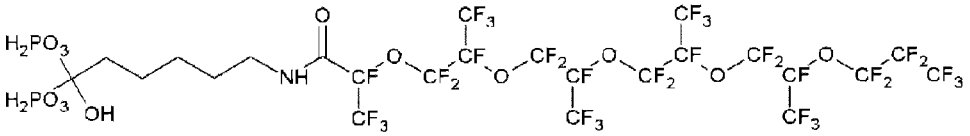
Figure 2:
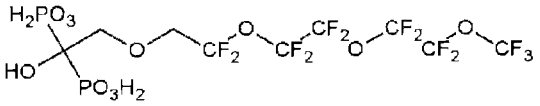
Figure 2:
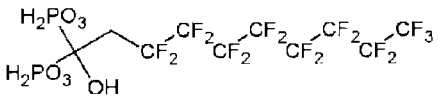
Figure 2:
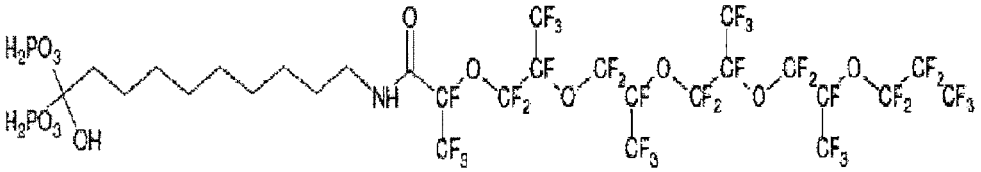

The present Inventors have demonstrated that a coating composition comprising i) thiol compounds, mixed with ii) bisphosphonic compounds can cover a large number of surfaces of watch components, including those made of gold, silver or their alloys, and silicon or glass, and increase the epilame effect of watch lubricants conventionally used on these surfaces in a highly effective and permanent manner. In fact the monolayers formed as a result of coating the surfaces with the composition of the invention produce a considerable epilame effect. Moreover, they seem not to be affected by repeated cleaning of watch parts. Advantageously, the coating composition does not include a perfluorinated solvent.

In a first aspect, the present invention relates to the use of a coating composition, called the "coating composition of the invention", comprising at least one thiol compound and at least one bisphosphonic compound, or one of their salts, to increase the lipophobicity of a surface used in watchmaking or jewelry, in order to limit the spread of greasy lubricants and thereby to increase the epilame effect on these surfaces.

The thiol compounds present in the coating composition of the present invention have the formula:

HS-A-B—C

Wherein:

A is a $(CH_2)_m$—X— group, m being an integer between 0 and 100, and X being a saturated or unsaturated $C_0$-$C_{100}$ alkyl group, perfluorinated or partially fluorinated, the alkyl chain possibly being substituted or interrupted by 0 to 10 cycloalkyl or aryl groups that may be perfluorinated or not;

B is a) a single chemical bond, or an O, S atom or an S(CO), (CO)S or NR, (CO)NR, NR(CO) group, R being a hydrogen atom or $C_1$-$C_{10}$ alkyl, or b)

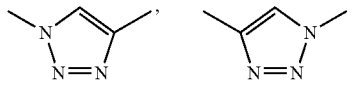

and

C is chosen from among: $F(CF(CF_3)CF_2O)_nCF(CF_3)$—, $F(CF_2CF(CF_3)O)_nCF_2CF_2$—, $F(CF_2CF_2CF_2)CF_2CF_2$—, and $F(CF_2CF_2O)_nCF_2$—, and $C_pF_{2p+1}$—, wherein n and p are integers between 1 and 100.

Moreover, said bisphosphonic compound present in the coating composition of the present invention has the formula:

Wherein:

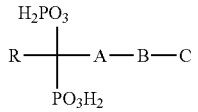

R is a hydrogen atom H or OH group,

A is a $(CH_2)_m$—X— group, m being an integer between 0 and 100, and X being a saturated or unsaturated $C_0$-$C_{100}$ alkyl group, perfluorinated or partially fluorinated, the alkyl chain possibly being substituted or interrupted by 0 to 10 cycloalkyl or aryl groups that may be perfluorinated or not;

B is a) a single chemical bond, or an O, S atom or an S(CO), (CO)S or NR, (CO)NR, NR(CO) group, R being a hydrogen atom or $C_1$-$C_{10}$ alkyl, or b)

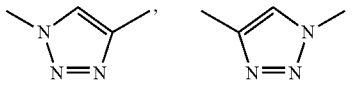

and

C is chosen from among: $(CF(CF_3)CF_2O)_nCF(CF_3)$—, $F(CF_2CF(CF_3)O)_nCF_2CF_2$—, $F(CF_2CF_2CF_2O)_nCF_2CF_2$—, $F(CF_2CF_2O)_nCF_2$ and $C_pF_{2p+1}$—, wherein n and p are integers between 1 and 100.

By "$C_0$-$C_{100}$ alkyl" group, we mean, in terms of the present invention, a saturated, linear or branched divalent hydrocarbon chain comprising 0 to 100, preferably 1 to 10, carbon atoms. Examples of this are methylene, ethylene, propylene, isopropylene, butylene, isobutylene, sec-butylene, pentylene or even hexylene groups.

By "perfluorinated", we mean a molecule substituted by at least one $CF_3(CF_2)$, group, n preferably being between 0 and 50, even more preferably between 0 and 10.

By "partially fluorinated", we mean a molecule whose carbon atoms are at least partially substituted by fluorine atoms.

By "cycloalkyl" group, we mean, in terms of the present invention, a cyclic saturated hydrocarbon chain, preferably including between 3 and 7 cyclic carbon atoms. An example of this is cyclopropyl, cyclopentyl, cyclohexyl and cycloheptyl groups.

By "aryl", we mean, in terms of the present invention, an aromatic group, preferably including 6 to 10 carbon atoms, and including one or more attached rings, such as for example the phenyl or naphthyl group. Advantageously this is a phenyl.

The possible salts include, in particular, sodium or potassium salts, calcium or magnesium salts, or salts formed by appropriate organic ligands such as quaternary ammonium salts. The salts are therefore preferably chosen from sodium, potassium, magnesium, calcium and ammonium salts.

Preferably, the thiol compound present in the coating composition of the invention is a perfluorinated thiol of following formula I:

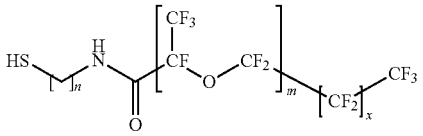

wherein: n is an integer between 1 and 100, m is an integer between 1 and 100 and x is an integer between 1 and 10, or a salt thereof, preferably a potassium, sodium, magnesium, calcium or ammonium salt.

Preferably, n is between 1 and 20, and even more preferably between 1 and 10; preferably, m is between 1 and 20 and even more preferably between 1 and 10; preferably x is between 1 and 5 and even more preferably x is equal to 1.

Preferably, the bisphosphonic compound present in the coating composition of the invention is a perfluorinated bisphosphonic of following formula II:

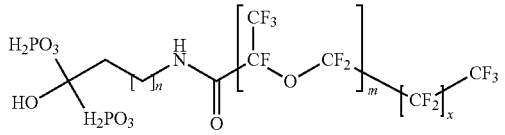

wherein: n is an integer between 1 and 100, m is an integer between 1 and 100 and x is an integer between 1 and 10, or a salt thereof, preferably a potassium, sodium, magnesium, calcium or ammonium salt.

Preferably, n is between 1 and 20, and even more preferably between 1 and 10; preferably, m is between 1 and 20 and even more preferably between 1 and 10; preferably x is between 1 and 5 and even more preferably x is equal to 1.

According to a preferred embodiment, the bisphosphonates present in the coating composition of the invention therefore carry a perfluorinated group (BP-PF) or perfluoropolyether (BP-PFPE) such as described in patent application No. FR2904784 and EP 2 054 165. As a result of the multiplicity of phosphonate groups (—$PO_3H_2$), these molecules are capable of permanently grafting onto mineral or metal surfaces in the form of self-assembled monolayers. Physicochemical characterisation of the monolayer obtained from these molecules is described in detail in the article of Lecollinet et al. (*Langmuir,* 2009). The bisphosphonate molecules bind in the form of self-assembled monolayers to metal or mineral materials, preferably oxides such as iron, titanium, copper, aluminium, nickel, tin or metal alloy (eg. steel, stainless steel, brass, nickel-silver, bronze, tin-nickel, nickel-phosphorus, copper-beryllium), ruby or sapphire. Reducing the surface energy of the treated material then becomes important (surface energy<20 mJ/$m^2$).

Preferably the coating composition of the invention is used to limit the spread of substances such as lubricants on metal surfaces, ceramics or semi-conductors intended for use in the watch or jewelry industry. "Lubricant" refers, in terms of the present invention, to oils or fats, in particular oils (or base oils in the case of fats) having kinematic viscosity measured at 20° C. of 10 to 2000 $mm^2$/s, and a surface tension measured at 20° C. of 25 to 40 mN/m.

In other words, said coating composition makes it possible to increase the epilame effect on a surface for use in watch-making or jewelry.

The coating composition can be liquid, gaseous or supercritical. When it is liquid, the coating composition of the invention can be an aqueous or organic composition. The liquid composition solvent is selected to allow the two types of compound present in the composition to be dissolved. This organic solvent can be chosen from alcohol solvents, in particular $C_1$ to $C_6$ alcohol such as isopropanol, ethanol, methanol, aldehydes, ketones such as acetone, ethers such as diethylether or tetrahydrofurane or alkanes, notably $C_1$ to $C_8$ alkanes as well as mixtures thereof. The composition can be a gas, BP compounds and thiols can notably be in the vapour state. "Supercritical composition" refers to a composition which is found in a supercritical fluid state.

The coating composition of the invention is advantageously in the form of a solution, a suspension, an emulsion, a supercritical fluid, an aerosol or a foam. Content in bisphosphonic compounds in the liquid coating composition is preferably between 0.0001 and 20% by weight, preferably between 0.001 and 5% by weight, and the content in thiol compounds in the liquid coating composition is preferably between 0.0001 to 20% by weight, preferably between 0.001 and 5% by weight.

According to one embodiment, the thiol compounds and BP are incorporated into the coating composition of the invention at a molar concentration of between $10^{-1}$ and $10^{-15}$ mol/L of each compound, preferably between $10^{-3}$ and $10^{-5}$ mol/L. Advantageously the two compounds, thiol and bisphosphonate have the same concentration.

In a preferred embodiment the surface of the watch component is composed of more than 50%, preferably more than 75%, even more preferably 85%:

- noble metals selected from gold (Au), platinum (Pt), silver (Ag) and copper (Cu),
- oxidised metals selected from iron (Fe), titanium (Ti), aluminium (Al), nickel (Ni), ruthenium (Ru), rhodium (Rh), and tin (Sn),
- alloys selected from steel (alloy or iron and carbon), stainless steel, brass (an alloy of copper and zinc), nickel-silver (an alloy of copper, nickel and zinc), bronze (an alloy of copper and tin), tin-nickel (Sn—Ni), nickel-phosphorus (Ni—P), copper-beryllium (Cu—Be), palladium-nickel (Pd—Ni), copper-cobalt (Cu—Co), or alloys comprising vanadium (V), chromium (Cr), manganese (Mn), zinc (Zn), tungsten (W), or zirconium (Zr), or an amorphous crystalline structure alloy, or
- ceramic or glass such as ruby (alloy of aluminium oxide and chromium, CAS no. 12174-49-1), sapphire (aluminium oxide, CAS no. 1317-82-4), zircon, silica or alumina or
- semi-conductors such as silicon (Si) or germanium (Ge) as well as oxides thereof, or even diamond.

In the context of the invention, an alloy is called "amorphous" when atoms do not follow any medium and long distance order (contrary to crystallized compounds). Glass and elastomers are amorphous compounds.

In the context of the present invention, ceramics are crystalline or partly crystalline structures, or of glass, and formed essentially by inorganic and non-metallic substances, by a melting mass which solidifies on cooling, or which is formed and brought to maturity simultaneously or subsequently through the effect of heat. This may include oxide ceramics (oxides of aluminium, zirconium), non-oxide ceramics (carbides, borides, nitrides, ceramics composed of silicon and carbon such as tungsten, magnesium, platinum or titanium), or finally ceramic composites (combination of oxides and non-oxides such as rubies).

Preferably, the coating composition of the invention contains a perfluorinated thiol compound of formula I such as that defined above, and a perfluorinated bisphosphonic compound of formula II such as that defined above.

Even more preferably, the composition of the invention contains a perfluorinated thiol compound of formula I wherein n=6, m=4, and x=1, or n=2, m=4 and x=11, or n=6, m=5 and x=1, or n=2, m=5 and x=1, or n=10, m=5, and x=1, and a perfluorinated bisphosphonic compound of formula II wherein n=4, m=4 and x=1 or n=8, m=5, and x=1.

Most preferably of all, the composition of the invention contains a perfluoropolyether thiol compound of formula I wherein n=6, m=5 and x=1, and a perfluorinated bisphosphonic compound of formula II wherein n=4, m=4 and x=1. This mixture shows the best epilame effect (see examples below).

The solvent of the liquid coating composition of the invention is selected so as to allow solubilisation of the two types of compounds it contains. This solvent may be selected from alcohol solvents, especially $C_1$ to $C_6$ alcohols such as isopropanol, ethanol, methanol, aldehyde, ketones such as acetone, ethers such as diethylether or tetrahydrofluran or alkanes, particularly $C_1$ to $C_8$ alkanes as well as mixtures thereof. Even more preferably, the solvent is isopropyl alcohol (IPA) (or isopropanol).

In a second aspect, the present invention relates to a method for coating a surface for watch-making or jewelry with a molecular functionalisation layer, characterised in that it comprises at least the following steps:

a) optionally degreasing the surface by washing with a solvent and then drying,
b) optionally oxidising the surface so as to create hydroxyl groups at the surface of the substrate,
c) contacting the surface with the composition of the invention, up to the point of self-assembly of thiol and/or bisphosphonic compounds in a single layer covering said surface,
d) removing the supernatant,
e) optionally dehydrating the surface thus coated,
f) rinsing the functionalised surface,
g) drying the functionalised surface, preferably with heat.

In the context of the present invention, by "molecular functionalisation layer" we mean a layer consisting of molecules which are each anchored to the substrate by at least one of their endings and arranged adjacent to each other. The molecules are anchored to the substrate preferably by thiols or bisphosphonic endings and are not linked to each other covalently. Their surface organisation and the different chemical groups they carry make it possible to modify the chemical and physical properties of surfaces coated in this way. The thickness of the molecular layer obtained by the method of the present invention is preferably in the nanometer range, in other words between 0.1 nm and 50 nm.

By "hydroxyl substrate", we mean a substrate whose surface has —OH functions as well as X—OH functions (X being a component element of the surface). The more —OH groups the substrate surface presents, the greater the density of the gem-bisphosphonic compounds attached to this surface will be.

It is possible to use pre-oxidation of the surface of the substrates so as to achieve a sufficient number of hydroxyl groups on the surface of the substrate (step b). In practice, preliminary oxidation of the surface of the substrate is carried out so as to have a sufficient number of hydroxyl groups on the surface of the substrate to allow binding of bisphosphonic compounds, when said substrate has none of them or substantially few. It can also be carried out when it is desirable to increase the number of hydroxyl groups already present in order to obtain greater surface coverage by the bisphosphonic compounds. For example, it is advantageous to carry out this oxidation step on a surface comprising essentially of silicon.

According to the method of the present invention, the surface is contacted with a liquid coating composition containing BP and thiols until self-assembly of said compounds takes place into a layer covering said surface (step c). Typically, the duration of contact of the composition on the surface to be treated is between 10 seconds and 6 hours, preferably between 1 minute and 1 hour, even more preferably between 3 minutes and 30 minutes. Contacting the liquid coating composition with the substrate surface is advantageously carried out by soaking, spin coating, wiping, spraying, aerosol or spray. When the coating composition is gaseous or supercritical, contact with the substrate surface can be carried out using a reactor whose pressure and temperature are controllable and which allows injection of a gas such as $CO_2$.

After the step contacting the surface with the coating composition, elimination of the coating composition is carried out (step d) in order to eliminate the solvent and all thiol and bisphosphonic compounds from the surface which did not bind to the substrate in the course of contacting. Elimination of the coating composition can be carried out by rinsing or mechanically by draining, centrifugation or evaporation. The surface can moreover be rinsed, in particular by immersion in an appropriate solvent in order to carry out complete elimination of the non-bound solution. Said appropriate solvent is preferably used to prepare the solution.

The method of the present invention allows covalent type grafting of BP and/or thiols to oxidised metallic or ceramic surfaces (step e), possibly using dehydration techniques by heating whether under reduced pressure or not which allow transformation of an electrostatic interaction into a P—O—X type covalent bond (X being a constituent element of the surface). It is advantageous to carry out this dehydration step on rubies for example.

Preferably, the surface dehydration step is carried out thermally, advantageously under reduced pressure, in particular by means of a lyophiliser. More particularly, dehydration of the substrate surface can be carried out by heating it at a temperature between 20° C. and 150° C., preferably at about 50° C. under pressure between 0.01 mBar and 1 Bar, preferably at 0.3 mBar, for a period of time between 1 and 72 hours, preferably for around 15 hours. It is also possible to dehydrate the surface at atmospheric pressure for 15 hours at 120° C.

The surface is rinsed (step f), in particular by immersion in an appropriate solvent in order to ensure complete elimination of non-bound solution. This step can be carried out using ultrasound. Said appropriate solvent is preferably that used to prepare the solution.

Steps e) and f) can be reversed, with rinsing taking place before dehydration of the coated surface.

The surface can be dried (step g) under hot air, for example at 70° C. for 2 minutes.

Steps c) to f) of the coating method of the invention can be repeated which improves the efficacy of coating.

The method of the present invention makes it possible to coat the surfaces of watch components consisting of over 50%, preferably over 75%, even more preferably of 85%:

- noble metals selected from gold (Au), platinum (Pt), silver (Ag) and copper (Cu),
- oxidised metals selected from iron (Fe), titanium (Ti), aluminium (Al), nickel (Ni), ruthenium (Ru), rhodium (Rh), and tin (Sn),
- alloys selected from steel (alloy or iron and carbon), stainless steel, brass (an alloy of copper and zinc), nickel-silver (an alloy of copper, nickel and zinc), bronze (an alloy of copper and tin), tin-nickel (Sn—Ni), nickel-phosphorus (Ni—P), copper-beryllium (Cu—Be), palladium-nickel (Pd—Ni), copper-cobalt (Cu—Co), or alloys comprising vanadium (V), chromium (Cr), manganese (Mn), zinc (Zn), tungsten (W), or zirconium (Zr), or an amorphous crystalline structure alloy, or
- ceramic or glass such as ruby (alloy of aluminium oxide and chromium), sapphire (aluminium oxide), zircon, silica or alumina or
- semi-conductors such as silicon (Si) or germanium (Ge) as well as oxides thereof, or even diamond.

According to a preferred embodiment, the surface consists of gold, steel, silicon, Ni, NiP, rubies or SnNi.

Finally, in a third aspect, the present invention concerns the use of a functionalised surface by means of the method of the invention in mechanical components used in watchmaking or jewelry.

These mechanical components are, for example, wheels, axles, gears, stones, anchors, arms, springs, drums, cylinder covers or even blanks.

The present invention also describes compositions comprising an effective amount of thiols and bisphosphonic compounds preferably of formula (I) and (II), or their toxicologically acceptable salts, capable of binding permanently to the surface of watch components to be protected and able to increase:

i) the lipophobicity of coated surfaces, and/or ii) the epilame effect of these surfaces towards the lubricants used in the watch-making industry.

Preferably, said watch lubricant is an oil or a fat. The oils, respectively fat based oils conventionally used in watches have kinematic viscosity measured at 20° C. of between 10 and 2000 $mm^2/s$ and a surface tension measured at 20° C. of between 25 and 40 mN/m, such as the exhaust oil 941, the high pressure oil SYNT-HP1300, the high sped oil SAL9040 (references Moebius House S.A.).

The epilame effect is conventionally evaluated by measuring the contact angle of the lubricants or of a test fluid (water, test liquids NSSC test) on the surface of the component.

The increased epilame effect permitted by the composition of the invention must be such that this contact angle with a watch oil is greater than 30°, preferably 35°, even more preferably 40°, as such an angle corresponds to very high epilame efficacy (see Renaud 1956, Osowiecki 1962 and Massin 1971).

More particularly, the present invention thus concerns the use of the coating composition of the invention to obtain a contact angle between the watch oil and the coated surface of at least 30°.

Preferably the coating composition of the invention makes it possible to increase the epilame effect towards watch oils with a viscosity of between 50 and 2000 $mm^2/s$.

By the term "effective amount", we mean that the amount of compound applied makes it possible, after coating, to form a monomolecular layer which increases the epilame effect on the surfaces of watch components.

In another aspect, the present invention relates to a coating composition comprising at least one thiol compound of formula I wherein n=6, m=5 and x=1, that is formula I.3:

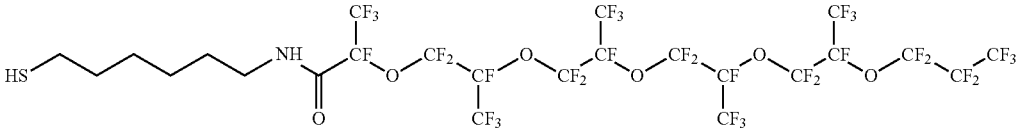

or a salt thereof, preferably a potassium, sodium, magnesium, calcium or ammonium salt.

The present Inventors have in fact discovered that this particular molecule is more effective in increasing the epilame effect on the surfaces of watch components than other molecules of formula I (see example 9 below).

The present invention therefore also concerns the use of a composition containing, as the only coating active ingredient, the thiol compound of formula I.3:

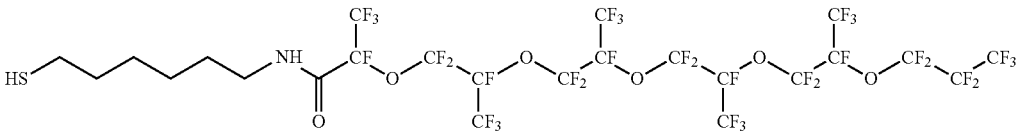

to increase the lipophobicity of a surface used in watchmaking or jewelry, and therefore the epilame effect on such a surface.

Preferably, said surface contains more than 50% gold, silver or copper.

This coating composition can be an aqueous or organic composition comprising an organic solvent selected from alcoholic solvents, especially $C_1$ to $C_6$ alcohols such as isopropanol, ethanol, methanol, aldehydes, ketones such as acetone, ethers such as diethylether or tetrahydrofurane or alkanes, notably $C_1$ to $C_8$ alkanes as well as mixtures thereof. The solvent can also consist of hydrotreated naphthas (for example the solvent Biosane T212 by MMCC). Preferably the solvent is isopropanol and/or a hydrotreated naphtha compound.

EXAMPLES

1. Synthesis of a Thiol-PFPE Compound I.3 of Formula I According to the Invention The compound I.3 (identified on FIG. 1) can be prepared in four steps following the synthesis plan presented below.

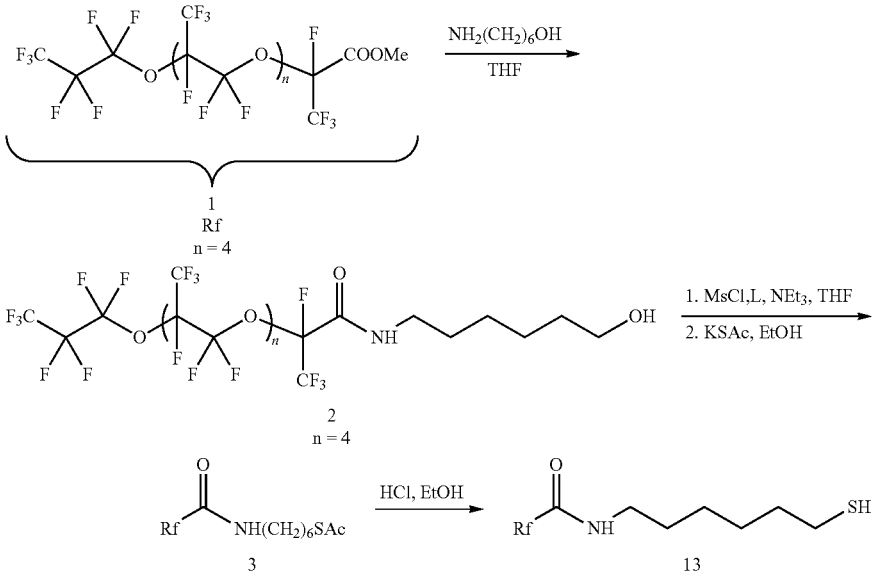

Preparation of Alcohol 2

6-aminohexan-1-ol (3.5 g; 29.7 mmol, 3 eq) was dissolved in 40 mL of THF under argon in a 100 mL triple-neck flask fitted with a condenser. Methyl ester 1 (10 g; 9.9 mmol) was added in a single addition. The biphasic mixture was heated at 50° C. until the perfluorinated derivative was completely dissolved (around 20 minutes) then stirred at room temperature under argon for 17 hours. After concentration on a rotary evaporator, the syrup obtained was taken up in AcOEt (120 mL) washed with a solution of 0.5 N hydrochloric acid solution (40 mL) then with distilled water (40 mL) and finally with brine (30 mL). The organic phase was dried ($MgSO_4$), filtered then concentrated under vacuum (rotary evaporator then vane pump). Amide 2 is obtained in the form of a colourless oil.

Mass obtained: 10.3 g

Yield: 95%

1H NMR (270 MHz acetone-$d_6$) δ (ppm)=3.53 (t, 21, CH2OH), 3.37 (m, 2H, CH2NH), 1.71-1.29 (m, 8H, 4 CH2).

13C NMR (acetone-d6) δ (ppm)=158.1 (d, J2C—F=24.9 Hz, CONH), 126.1-101.2 (m, CFs), 62.7 (CH2OH), 41.1 (CH2NH), 33.9, 29.8, 27.5, 26.5 (4 CH2).

Preparation of Thioacetate 3

Amide 2 (10.3 g, 9.4 mmol) placed in a 250 mL single neck flask was dissolved in 60 ml of THF under argon. Triethylamine (3.97 mL, 3 eq.) was added then methane sulphonyl chloride (1.46 mL, 2 eq.) while being cooled in an ice water bath. The suspension was stirred at room temperature under argon for 17 h. After concentration in the rotary evaporator, the mixture was taken up in AcOEt (120 mL) then washed in distilled water (50 mL) and finally in brine (40 mL). The organic phase was dried (MgSO4), filtered then concentrated under vacuum (rotary evaporator). The colourless oil obtained (mesylate) was dissolved in 150 mL of EtOH, potassium thioacetate KSAc (2.14 g, 2 eq.) was added to the solution then heated under argon at 60° C. for 2 h. After cooling down to room temperature, the mixture was concentrated in the rotary evaporator, the residue was taken up in AcOEt (120 mL) then washed with distilled water (2×50 mL) and finally in brine (40 mL). The organic phase was dried (MgSO4), filtered then concentrated under vacuum (rotary evaporator). The thioacetate 3 was obtained in the form of an orange oil.

Mass obtained: 9.5 g

Yield: 88%

1H NMR (270 MHz acetone-d6) δ (ppm)=3.37 (m, 2H, CH2NH), 2.85 (t, 2H, CH2S), 2.28 (s, 3H, SAc), 1.75-1.29 (m, 8H, 4 CH2).

13C NMR (acetone-d6) δ (ppm)=195.4 (COCH3), 158.5 (d, J2C—F=24.9 Hz, CONH), 125.9-100.9 (m, CFs), 41.1 (CH2NH), 30.6, 29.6, 29.2, 27.1 (CH3, CH2).

Preparation of Thiol PFPE of Formula I.3

40 mL of concentrated HCl (10 N) was added to a solution of thioacetate 3 (9.5 g, 8.2 mmol) in 300 mL of EtOH. The red solution was heated to 90° C. for 2 h. After cooling to room temperature, the mixture was concentrated in a rotary evaporator, the residue was taken up in AcOEt (120 mL) then washed in distilled water (2×50 mL) and finally in brine (40 mL). The organic phase was dried (MgSO4), filtered then concentrated under vacuum (rotary evaporator). After drying in a vane pump (heating at 50° C.), thiol PFPE (13) was obtained in the form of an orange oil.

Mass obtained: 7.9 g

Yield: 86%

$^1$H NMR (270 MHz, acetone-d6) δ (ppm)=8.51 (s, 1H, $CH_2NH$), 3.38 (m, 2H, $CH_2NH$), 2.50 (t, 2H, $CH_2S$), 1.72-1.27 (m, 8H, 4 $CH_2$).

$^{13}$C NMR (acetone-d6) δ (ppm)=158.5 (d, $J_{C-F}^2$=24.9 Hz, CONH), 124.8-101.2 (m, CFs), 41.1 ($CH_2NH$), 35.1 ($CH_2CH_2SH$), 29.7, 28.9, 27.2 (3 $CH_2$), 25.0 ($CH_2SH$).

The other thiol-PFPE compounds are easily obtained according to a similar synthesis method using the following compounds:

Perfluororo-2,5,8,11-tetramethyl-3,6,9,12-methyl tetraoxapentadecanoate to obtain compound I.1.

Mercaptoethylamine and perfluororo-2,5,8,11-tetramethyl-3,6,9,12-methyl tetraoxapentadecanoate to obtain compound I.2.

Mercaptoethylamine and perfluororo-2,5,8,11,14-pentamethyl-3,6,9,12,15-methyl pentaoxaoctadecanoate to obtain compound I.4.

Mercaptoethylamine and methyl perfluoro-octanoate to obtain compound I.5

10-amino-decan-1-ol and perfluoro-2,5,8,11,14-pentamethyl-3,6,9,12,15-methyl pentaoxaoctadecanoate to obtain compound I.6.

2. Synthesis of a BP-PFPE Compound (for Example II.1) of Formula II According to the Invention The molecule II.1 can be prepared in four steps following the synthesis diagram below:

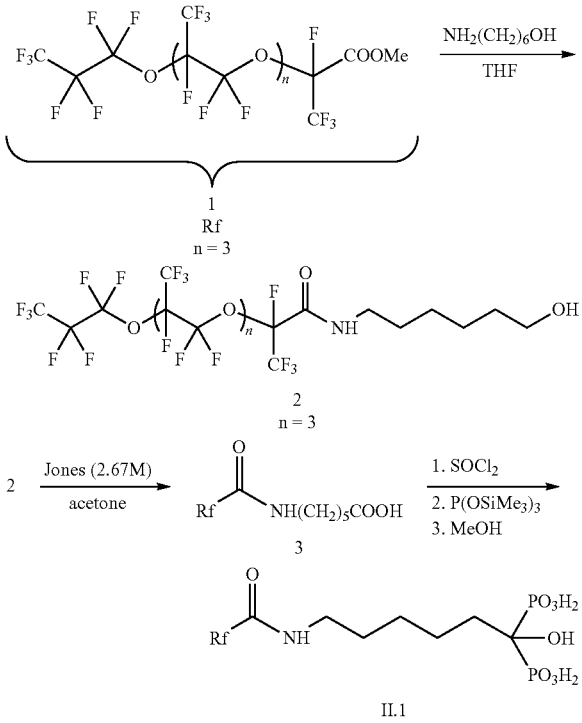

Firstly, 6-aminohexan-1-ol was acylated by the methyl ester PFPE 1 in THF at room temperature to produce the corresponding amide 2. The alcohol group was then oxidised into carboxylic acid 3 through the action of Jones reagent. Finally compound 3 is transformed into bisphosphonic acid II.1 via an acid chloride.

The operating method is described below:

Dissolve 6-aminohexanol (1.25 g; 10.7 mmol) in 15 mL of anhydrous THF in a 50 mL single-neck flask under argon. The methyl ester 1 (3 g; 3.56 mmol) was added in one addition. The biphasic mixture which becomes homogeneous and clear after a few minutes was stirred at room temperature for 17 hours. After concentration in the rotary evaporator, the syrup obtained was taken up in AcOEt (25 mL), washed with a 1N hydrochloric acid solution then with water. The organic phase was dried ($MgSO_4$), filtered then concentrated under vacuum (rotary evaporator then vane pump). The colourless molecule 2 oil was obtained.

The alcohol 2 (3.1 g, 3.3 mmol) was dissolved in 40 mL of acetone. A 2.67 M solution of Jones reagent was added drop by drop. After 15 minutes of stirring at room temperature, a few drops of isopropanol were added, then the mixture was filtered, concentrated, taken up in AcOEt and washed twice with water. The organic phase was dried, filtered then concentrated under vacuum (rotary evaporator then vane pump). Carboxylic acid 3 was obtained in the form of a colourless oil.

Carboxylic acid 3 (3.1 g; 3.3 mmol) was mixed under argon with 8 mL of thionyl chloride. The mixture was then heated under reflux for 45 minutes then concentrated under vacuum. The syrup obtained was placed under argon then $P(OSiMe_3)_3$ was added (2.5 eq., 2.75 mL). The solution was stirred under argon for 2 h, concentrated under vacuum then 10 mL of methanol was added. After 1 h of stirring, the mixture was concentrated. The syrup obtained was washed with water. The molecule 11.1 was then dried on the vane pump.

The other components of BP-PFPE are easily obtained according to a similar synthesis method, using the following compounds:

Perfluoro-2,5,8,11,14-pentamethyl-3,6,9,12,15-methyl pentaoxaoctadecanoate to obtain the compound II.2.

1H, 1H-perfluoro-3,6,9-trioxadecan-1-ol to obtain the compound II.3.

1H,1H,2H,2H-perfluorodecan-1-ol to obtain the compound II.4.

10-amino-decan-1-ol and perfluoro-2,5,8,11,4-pentamethyl-3,6,9,12,15-methyl pentaoxaoctadecanoate to obtain the compound II.5.

3. Example of the Deposit Method According to the Invention

Preparation of the BP/Thiol-PFPE Mixture Solution

To prepare 50 mL of the mixture according to the invention:

a) Weigh 1.09 g of compound BP-PFPE of formula II.1 and dissolve it in 25 mL of isopropyl alcohol (IPA).

b) Weigh 1.11 g of compound thiol-PFPE of formula I.3 and dissolve in 25 mL of IPA.

c) Mix the previous 2 solutions in an Erlenmeyer flask for 30 min, filter the mixture on filter paper if a slight precipitate is formed. Pour the mixture into a Nalgene type bottle and store at room temperature away from light.

d) Dilute to one twentieth in IPA.

Preparation of Materials

Degrease the parts by washing in a solvent (acetone or IPA) under ultrasound for 5 minutes then dry the parts under a stream of hot air.

In the case of silicon, oxidation of the material is recommended to promote grafting. This oxidation is carried out as follows:

1. The silicon part is immersed in a Piranha solution (cone $H_2SO_4/H_2O_2$ at 30% 3:1) freshly prepared for 45 min.
2. The part is rinsed 3 times in deionised water.
3. The part is dried for 10 minutes in an oven at 80° C.

Deposit

Place the watch part or parts in a container with an adapted shape,

Cover the part or parts with coating solution (thiol, BP or BP/thiol-PFPE mixture), Incubate between 5 minutes and 360 minutes, Eliminate the supernatant—remove the part, The part is drip dried (centrifugation).

Dehydration—Rinsing

The part which received the deposit is placed in an oven at 120° C. for a period ranging from 6 to 15 h (only for rubies and silicon), The part is brought back to room temperature then immersed in IPA under ultrasound for 2 minutes, The part is dried under a stream of hot air.

The "deposit" and the "dehydration-rinsing" steps can be repeated.

4. Solubility of the Thiol-PF and BP-PF Compounds of the Invention 4.1. The solubility of perfluorinated thiol molecules, perfluoro-BP molecules and mixtures consisting of these two categories of molecules were analysed in four solvents:

1) 3-methoxy-methylbutan-3-ol (MMB),
2) Acetone (ACE),
3) Isopropanol (IPA) and
4) the solvent Biosane T212 of brand MMCC (T212) which consists of hydrotreated naphthas.

The advantage of the latter solvent is that it is very volatile and hardly flammable.

The solubilisation of molecules was carried out in the usage concentrations, that is between $10^{-3}$ and 10−5 M.

The method employed to test dissolution was the following:

For study solvents (MMB, ACE and IPA), the compounds were individually diluted in the solvent with magnetic stirring at room temperature to obtain a final solution with concentrations ranging between $10^{-3}$ and $10^{-5}$ M, For solvent T212, the compounds were initially dissolved in isopropanol (IPA) under magnetic stirring and at room temperature to obtain solution S. This solution S was then diluted to 5% in the solvent so as to obtain a final solution with concentrations ranging between $10^{-3}$ and $10^{-5}$ M.

For each of these tests, the molecules were considered to be dissolved when the solution showed no cloudiness. The results of the test are as follows:

All the molecules developed are independently soluble in solvent T212 as well as in IPA;

The majority of perfluorinated thiols and perfluoro-BP molecules are soluble in all the studied solvents;

Molecule I.4 is weakly soluble in MMB and ACE.

4.2 Solubility of BP-PF and Thiol-PF Compounds in the Composition of the Invention.

The solubility of the thiol-bisphosphonate mixture may be modified as a function of the length of molecule chains, their respective concentrations and the type of solvent used. All the mixtures are soluble in IPA.

5. Lipophobic Effect of the Composition of the Invention 5.1. Deposit Protocol Different surfaces were treated with solutions of thiol I.3 and BP II.1 molecules. The solutions were freshly prepared. The tests were carried out with solutions containing $10^{-3}$ M of each of the molecules dissolved in IPA. The final solution was then deposited on gold, rubies, steel 20 AP, and on NiP and SnNi alloys. The soaking time was 30 minutes, the rinsing time was 2 minutes.

The lipophobic effect was evaluated by measuring the contact angles of a test oil having surface tension of 33 mN/m on different surfaces. All the surfaces showed a satisfactory epilame effect.

5.2. Epilame Effect on Different Materials

Demonstration of the Epilame Effect by Measurement of Contact Angles

According to the epilame method described in paragraphs 3 and 5.1, the materials were treated by the mixture of the thiol molecule I.3. with the BP molecule II.1. dissolved in IPA. The contact angles were measured before and after treatment of the surface.

In accordance with the reference articles in the watchmaking literature (Renaud 1956, Osowiecki 1962 and Massin 1971), an angle of over 40° with a watch lubricant corresponds to very high epilame efficacy.

The results before and after epilame treatment are presented in the two tables below:

TABLE 1

| contact angles on materials before epilame | | | | | |
|---|---|---|---|---|---|
| | Au | Rubies | Steel | NiP | SnNi |
| $H_2O$ | 99.6° ± 2.1 | 49.7° ± 7.2° | 97.1° ± 0.9° | 96.8° ± 2.0° | 98.3° ± 1.4° |
| Test oil | 15.3° ± 2.7° | 24.7° ± 2.0° | 19.5° ± 3.7° | 25.6° ± 2.7° | 35.1° ± 6.5° |

TABLE 2

| contact angles on materials after epilame | | | | | |
|---|---|---|---|---|---|
| | Au | Rubies | Steel | NiP | SnNi |
| $H_2O$ | 111.8° ± 2.2 | 105.0° ± 5.2° | 101.7° ± 2.3° | 110.6° ± 5.2° | 107.1° ± 3.0° |
| Test oil | 61.5° ± 3.5° | 63.6° ± 1.9° | 61.0° ± 5.0° | 68.3° ± 3.9° | 65.5° ± 3.2° |

Demonstration of the Epilame Effect by Measurement of Surface Energies

The contact angles measured from drops of water, glycerol and diiodomethane on different materials before and after epilame made it possible to calculate the surface energies according to the Owens Wendt method.

TABLE 3

| surface energies of materials before epilame | | | | | |
|---|---|---|---|---|---|
| | Au | Rubies | Steel | NiP | SnNi |
| Surface energy (mJ/m$^2$) | 36.0 | 52.6 | 34.1 | 39.3 | 34.3 |
| Dispersive component | 34.5 | 25.7 | 30.7 | 37.4 | 31.5 |
| Polar component | 1.5 | 27.0 | 3.4 | 1.9 | 2.8 |

TABLE 4

| surface energies of materials after epilame | | | | | |
|---|---|---|---|---|---|
| | Au | Rubies | Steel | NiP | SnNi |
| Surface energy (mJ/m$^2$) | 15.1 | 18.0 | 19.5 | 13.0 | 19.6 |
| Dispersive component | 13.7 | 16.0 | 18.5 | 12.2 | 18.1 |
| Polar component | 1.4 | 2.0 | 1.0 | 0.7 | 1.4 |

5.3. Effect of Coating Time

The two compounds of the invention I.1 and II.1 were mixed either at $10^{-3}$ M or at $10^{-4}$ M in IPA and contact with gold lasted 0, 10, 30, 60 or 360 minutes.

With regard to the results presented in the table below, it appears that a coating step lasting 10 minutes is sufficient for the surface to be well functionalised. This time is therefore considered to be advantageous for carrying out the method of the invention. As indicated below, functionalised surfaces were obtained with treatment times of 5 minutes. Tests showed that times below 5 minutes (for example 1 minute) are also sufficient to obtain functionalised surfaces.

TABLE 5

| contact angles of the test oil with epilame treated parts by means of a solution according to the invention (containing $10^{-3}$ M of compound I.1 and $10^{-3}$ M of compound II.1 or $10^{-4}$ M of compound I.1 and $10^{-4}$ M of compound II.1) as a function of coating time (0, 10, 30, 60 and 360 minutes). | | | | | |
|---|---|---|---|---|---|
| Time (min) | 0 | 10 | 30 | 60 | 360 |
| $10^{-3}$ M | 25.6 ± 2.7° | 50.4 ± 8.8° | 60.8 ± 5.8° | 63.2 ± 3.7° | 76.4 ± 0.6° |
| $10^{-4}$ M | 25.6 ± 2.7° | 36.6 ± 11.1° | 54.4 ± 4.7° | 55.7 ± 7.7° | 68.9 ± 2.5° |

6. Effect of the Concentration of the Compound of Formula I and II

In order to evaluate the lipophobic properties of thiol/BP mixtures, coating of different materials by soaking these molecules in solution in IPA for 30 minutes followed by rinsing with IPA for 2 minutes under ultrasound (US) was carried out.

The following mixtures were tested:

| Mixture No | Thiol PFPE (I.3) | Bisphosphonate PFPE (II.1) |
|---|---|---|
| 1 | $10^{-3}$ M | $10^{-3}$ M |
| 2 | $10^{-4}$ M | $10^{-3}$ M |
| 3 | $10^{-3}$ M | $10^{-4}$ M |

The test solution which gave the best results is mixture number 1 comprising a mixture of 50% of molecule I.3 (at $10^{-3}$ M) and 50% bisphosphonate II.1 (at $10^{-3}$ M). The proportion of each of the molecules in the mixture has a particular effect on the quality of surface treatment but all the mixtures and the different thiol and BP molecules tested led to a self-assembled layer with the required oleophobic properties for watch-making applications.

It is also possible to carry out several successive deposits on the same compound with an intermediate rinsing.

Molecule I.3 was selected for continuation of the study given that the contact angles obtained for this molecule were the highest. Nevertheless, the other molecules also result in functional layers with a satisfactory epilame effect.

The results obtained are given in the form of a contact angle of a drop of water, respectively a drop of test oil on different materials.

TABLE 6 contact angles of water drops, the test oil respectively with parts made of gold-plated brass (Au), rubies, steel 20 AP, NiP and on SnNi coating as a function of soaking time in the epilame solution according to the invention (mixture of compounds I.3 and II.1 at $10^{-3}$M).

| Time | Liquid | Au | Rubies | Steel | NiP | SnNi |
|---|---|---|---|---|---|---|
| 0 min | $H_2O$ | 99.6 ± 2.1° | 49.7 ± 7.2° | 97.1 ± 0.9° | 96.8 ± 2.0° | 98.3 ± 1.4° |
| 0 min | Test oil | 25.6 ± 2.7° | 24.7 ± 2.0° | 19.5 ± 3.7° | 15.3 ± 2.7° | 35.1 ± 6.5° |
| 5 min | $H_2O$ | 115.5 ± 1.7° | 106.4 ± 1.7° | 102.3 ± 2.5° | 112.4 ± 2.3° | 104.7 ± 3.6° |
| 5 min | Test oil | 68.9 ± 3.5° | 72.5 ± 7.5° | 58.5 ± 7.1° | 70.7 ± 5.3° | 63.9 ± 2.9° |
| 10 min | $H_2O$ | 117.0 ± 2.8° | 108.0 ± 1.4° | 103.2 ± 1.6° | 114.0 ± 1.4° | 104.8 ± 1.2° |
| 10 min | Test oil | 68.6 ± 4.1° | 70.3 ± 3.3° | 63.3 ± 2.6° | 75.5 ± 3.1° | 62.6 ± 4.1° |
| 30 min | $H_2O$ | 112.3 ± 3.6° | 105.7 ± 4.7° | 110.8 ± 0.3° | 103.9 ± 1.0° | 108.1 ± 4.0° |
| 30 min | Test oil | 65.6 ± 1.9° | 71.8 ± 1.4° | 68.3 ± 5.6° | 73.1 ± 6.4° | 73.6 ± 4.6° |

In table 6, it can be seen that all the surfaces underwent epilame treatment in accordance with epilame specifications for watch-making (angle with oil>30°).

7. Resistance to Washing

The resistance of epilame layers of the invention was evaluated after one or several washing cycles by measuring the contact angle with $H_2O$ and the test oil. Good epilame hold on the various materials evaluated was observed, even after several washing cycles.

Moreover, the resistance to washing with Rubisol type products for gold was tested and showed that the epilame properties on gold resist well to Rubisol washing (angle>30°).

8. Epilame Effect of Different PF Thiol I.1-I.5 Molecules Alone

On the basis of the kinetics of molecule I.1, the following parameters were used to test the four other thiol-PF and thiol-PFPE molecules (I.2, I.3, I.4, I.5):

Concentration: $10^{-3}$ M for each compound I.1 to I.5

Solvent: Isopropyl alcohol (IPA) or Biosane T212 (MMCC)

Soaking Time: 30 minutes

Rinsing time: 2 minutes under ultrasound

Drying: hot air

Evaluation of functional properties was carried out by measuring the contact angles between the surface of the watch-making component and the drop of watch-making oil. The results are presented in the table below. It is noticeable that the concentration of $10^{-3}$ M gives results that comply with the desired epilame effect (angle greater than 30°) for all molecules I.1 to I.5.

TABLE 7 contact angle of the gold-plated brass part with the test oil as a function of solvent (MMCC or IPA) and the coating molecule I.1-I.5 used at $10^{-3}$ M.

| | IPA | MMCC |
|---|---|---|
| Reference | 25.6 ± 2.7° | |
| I.1 | 60.8 ± 5.8° | 64.5 ± 2.9° |
| I.2 | 48.5 ± 4.3° | 72.6 ± 1.6° |
| I.3 | 75.7 ± 6° | 63.8 ± 2.8° |
| I.4 | 69.9 ± 2.9° | 68.9 ± 2.5° |
| I.5 | 67.6 ± 3.6° | 49.5 ± 2.5° |

The different molecules moreover show good resistance to "Rubisol" type washing when the layer is made up of a solution of concentration $10^{-3}$ M of I.1 to I.5.

9. Epilame Effect of Thiol and Bisphosphonate Molecules and their Mixtures

The lipophobic/hydrophobic effect of thiol and bisphosphonate molecules was tested for each molecule alone, then for their mixtures in order to detect any synergetic effect produced by a combination of two types of molecule.

The following thiol molecules were tested:

I.3:

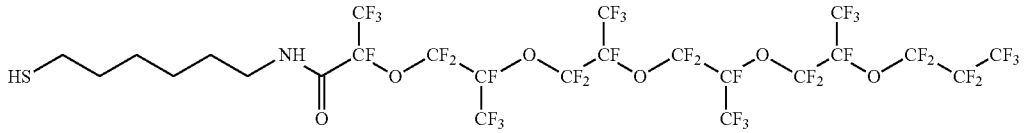

13-302. MW=1109, $C_{24}H_{14}F_{35}NO_6S$

I.6:

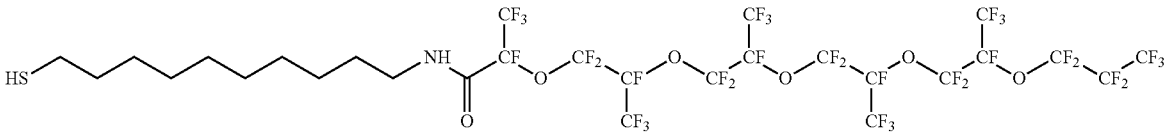

13-402. MW=1165, $C_{28}H_{22}F_{35}NO_6S$

Molecule I.3 corresponds to the molecule studied in examples 1 and 3 above. Molecule 13-402 (I.6) has a longer aliphatic group.

The following bisphosphonate molecules were tested:

II.1:

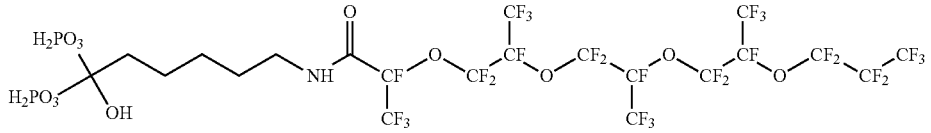

08-201, MW 1087, C21H16F29NO12P2

II.2:

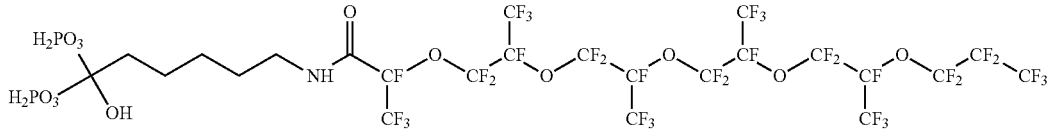

08-202, MW 1253, C24H16F35NO13P2

II.5:

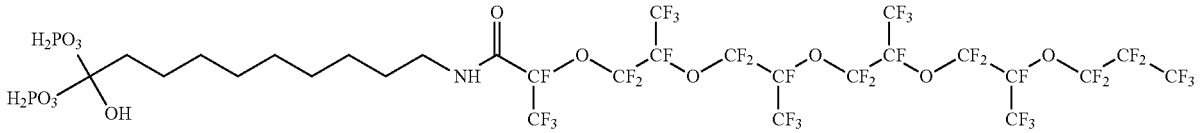

08-402, MW 1309. C28H24F35NO13P2

All the molecules were synthesised in quantities in the order of a gram with satisfactory yield. The purity of each compound is greater than 90%.

Properties of Thiol and Bisphosphonate Molecules Alone

The properties of thiol and bisphosphonate molecules in isolation were measured on the surfaces of steel and gold-plated substrates using solutions at $10^{-3}$ M and in isopropanol in accordance with the protocol described in example 3 above, with a soaking time of 5 minutes. The results obtained are as follows:

TABLE 8 contact angle of the gold-plated brass and steel parts with water and with the test oil for coating molecules used at $10^{-3}$ M in IPA.

| Molecule | Au $H_2O$ | Au Test oil | Steel $H_2O$ | Steel Test oil |
|---|---|---|---|---|
| II.1 BP | 101.3 | 51.7 | 98.6 | 47.3 |
| II.2 BP | 109.4 | 66.2 | 105.1 | 61.7 |
| I.3 thiol | 96.4 | 69.0 | 70.2 | 33.5 |
| I.6 thiol | 97.9 | 71.0 | 74.1 | 34.4 |

The standard deviation for three measurements is between 1 and 5°. It is noted that the two types of molecule allow valid functionalisation of gold plated substrate but that thiols alone do not bind (or bind very little) to steel.

Combination of Thiol and Bisphosphonate Molecules

Six mixtures were tested. For mixture 1 (I.3/II.1), it is necessary to refer to example 6 above.

TABLE 9 epilame solutions according to the invention tested within the scope of example 9 (mixture of thiol compounds I.3 and I.6 with bisphosphonate compounds II.1, II.2 and II.5 at $10^{-3}$ M and $10^{-4}$ M in IPA).

| Molecule | II.1 | II.2 | II.5 |
|---|---|---|---|
| I.3 | Mixture 1 | Mixture 4 | Mixture 5 |
| I.6 | Mixture 6 | Mixture 7 | Mixture 8 |

Solubility was qualified by observing the clarity of solutions on mixing with isopropanol, after 1 h and 24 h. The concentrations tested are $10^{-3}$ M and $10^{-4}$ M for each of the molecules. In all these configurations, no loss of solubility was noted.

The following table gives the results obtained:

TABLE 10 contact angle of water drops, test oil respectively with gold-plated brass, steel and ruby parts coated by soaking in an epilame solution according to the invention (mixtures 1 and 4 to 8, according to table 9, at $10^{-3}$M in IPA, soaking time of 5 minutes, treatment repeated twice)

| Mixture of molecules | Au $H_2O$ | Au Test oil | Steel $H_2O$ | Steel Test oil | Ruby $H_2O$ | Ruby Test oil |
|---|---|---|---|---|---|---|
| Mixture 1 | 112 | 64 | 103 | 68 | 105 | 64 |
| Mixture 4 | 111 | 68 | 106 | 73 | 106 | 76 |
| Mixture 5 | 111 | 82 | 110 | 74 | 112 | 71 |

TABLE 10-continued contact angle of water drops, test oil respectively with gold-plated brass, steel and ruby parts coated by soaking in an epilame solution according to the invention (mixtures 1 and 4 to 8, according to table 9, at $10^{-3}$M in IPA, soaking time of 5 minutes, treatment repeated twice)

| Mixture of molecules | Au $H_2O$ | Au Test oil | Steel $H_2O$ | Steel Test oil | Ruby $H_2O$ | Ruby Test oil |
|---|---|---|---|---|---|---|
| Mixture 6 | 101 | 80 | 104 | 45 | 114 | 69 |
| Mixture 7 | 112 | 81 | 107 | 69 | 113 | 71 |
| Mixture 8 | 112 | 79 | 109 | 70 | 114 | 76 |

Firstly, we find that epilame functionality is good for all mixtures, with a contact angle that is always greater than 60° with the test oil and always greater than 100° with water.

There is no important effect of concentration on the hydrophobic and oleophobic properties even though results are generally better at a concentration of $10^{-3}$ M.

Comparison of the results obtained with the mixtures and the molecules alone makes it possible to identify the following teachings: on gold-plated surfaces, the measured contact angles are similar for the molecules alone and for mixtures. On the other hand, the use of a mixture significantly improves hold over time, and in particular resistance to washing compared to the molecule alone. This may be explained by the fact that gold is a noble metal with no oxide group at the surface, which means that the BP hook has little possibility of attaching permanently to the surface. It should also be noted that a mixture leads to better resistance to washing than the thiol molecule alone, and that the combination of two molecules gives an unexpected effect. For steel, the contact angles after depositing are lower for the molecules alone than for mixtures. In addition, the mixtures have much better resistance to washing than the molecules used alone.

The results obtained for mixtures of molecules are better than when the molecules are used alone. The mixtures of these two classes of molecules are therefore clearly more advantageous than the same molecules used alone, even for surfaces where one of the molecules is meant to have a negligible effect (for example, Au for BP molecules), indicating an unexpected synergetic effect.

This synergetic effect between thiol and bisphosphonate molecules promotes their adhesion to materials when they are in mixture. It may also be explained by an arrangement between the different chemical groups of these molecules which results in reactive groups being preferentially presented at the surface of the material.

BIBLIOGRAPHY

Lecollinet G. et al., Langmuir, 2009, 25 (14), pp 7828-7835.

Bonard J.-M., Actes du Congrès International de Chronométrie 2004, p. 131, 2004

Bain C. D. et al, J. Am. Chem. Soc, 111(1), 321-335, 1989

Colorado R. et al, *Langmuir* 2003, 19 (8), 3288-3296

Folkers et al., *Langmuir*, (1995) 11, 813-824

Fukushima H. et al, *J. of Phys Chem b* 2000, 104, (31), 7417-7423

Massin M, Actes du congrès des Sociétés Allemande et Française de Chronométrie, p. 95 (1971).

Osowiecki M., Bulletin de la Société Suisse de Chronométrie SSC III, p. 735 (1957).

Renaud P. et al., Bulletin de la Société Suisse de Chronométrie III, p. 681 (1956)

Shi C. et al. *J. Supercriti. Fluids* 2000, 17, 81-90

Saunders et al, *J. Phys Chem B* 2004, 108, (41), 15969-15975

The invention claimed is:

1. A method comprising coating a surface of a watch or jewellery component with a synergistic composition comprising at least one thiol compound and at least one bisphosphonic compound or a salt thereof to form a coated surface, wherein said thiol compound is a perfluorinated thiol of the following formula I:

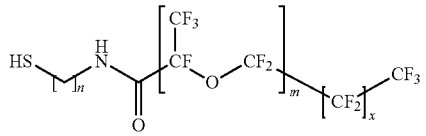

wherein: n is an integer from 6 to 10, m is 5 and x is 1;

wherein said bisphosphonic compound is a perfluorinated bisphosphonic of the following formula II:

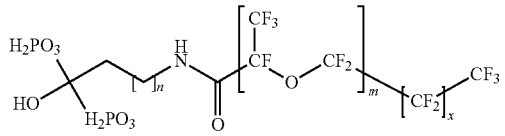

wherein: n is an integer from 4 to 8, m is an integer from 4 to 5 and x is 1; and wherein the lipophobicity of the coated surface is increased.

2. A method according to claim 1 wherein said method limits spread of oils or fats.

3. A method according to claim 1 wherein said surface contains more than 50% of:

noble metals selected from gold, platinum, silver and copper, oxidised metals selected from iron, titanium, aluminium, nickel, ruthenium rhodium, and tin, alloys selected from steel (alloy of iron and carbon), stainless steel, brass (an alloy of copper and zinc), nickel-silver (an alloy of copper, nickel and zinc), bronze (an alloy of copper and tin), tin-nickel, nickel-phosphorus, copper-beryllium, palladium-nickel, copper-cobalt, or alloys comprising vanadium, chromium, manganese, zinc, tungsten, or zirconium, or an amorphous crystalline structure alloy, or ceramic or glass or semi-conductors.

4. A method according to claim 3, wherein the ceramic or glass is ruby (alloy of aluminium oxide and chromium), sapphire (aluminium oxide), zircon, silica or alumina.

5. A method according to claim 3, wherein the semi-conductors are silicon (Si) or germanium (Ge) or oxides thereof, or diamond.

6. A method according to claim 3, wherein the surface contains more than 50% of noble metals selected from gold, platinum, silver, and copper or contains more than 50% of alloys selected from steel (alloy of iron and carbon), stainless steel, brass (an alloy of copper and zinc), nickel-silver (an alloy of copper, nickel and zinc), bronze (an alloy of copper and tin), tin-nickel, nickel-phosphorus, copper-beryllium, palladium-nickel, copper-cobalt, or alloys comprising vanadium, chromium, manganese, zinc, tungsten, or zirconium, or an amorphous crystalline structure alloy.

7. A method according to claim 1 wherein said perfluorinated thiol compound is a compound of formula I wherein or n=6, m=5 and x=1, or n=10, m=5, and x=1, and said perfluorinated bisphosphonic compound is a compound of formula II wherein n=4, m=4 and x=1 or n=8, m=5, and x=1.

8. A method according to claim 1 wherein said perfluorinated thiol compound is a thiol perfluoropolyether of formula I wherein n=6, m=5, and x=1, and the perfluorinated bisphosphonic compound is a compound of formula II wherein n=4, m=4, and x=1.

9. A method according to claim 1 wherein said bisphosphonic compounds and said thiol compounds are dissolved in an organic solvent selected from the group consisting of alcoholic solvents, aldehydes, ketones, ethers, alkanes, and mixtures thereof.

10. A method according to claim 9, wherein the organic solvent is a $C_1$ to $C_6$ alcohol, diethyl ether, tetrahydrofuran, a $C_1$ to $C_8$ alkane, or mixtures thereof.

11. A method according to claim 1, wherein the coated surface forms a contact angle with a watch oil of greater than 40°.

12. A method for coating a surface of a watch or jewellery component, comprising at least the following steps:

a) optionally degreasing the surface by washing with a solvent and then drying, b) optionally oxidising the surface so as to create hydroxyl groups at the surface of the substrate, c) contacting the surface with a synergistic composition comprising at least one thiol compound and at least one bisphosphonic compound or a salt thereof, up to the point of self-assembly of thiol and/or bisphosphonic compounds in a single layer coating said surface to form a coated surface and a supernatant, d) removing the supernatant, e) optionally dehydrating the coated surface, f) rinsing the coated surface, g) drying the coated surface, wherein said thiol compound is a perfluorinated thiol of the following formula I:

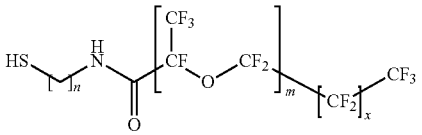

wherein n is an integer from 6 to 10, m is 5 and x is 1; and wherein said bisphosphonic compound is a perfluorinated bisphosphonic of the following formula II:

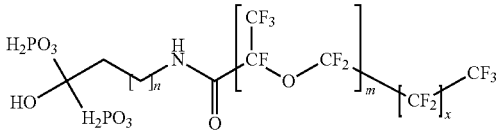

wherein n is an integer from 4 to 8, m is an integer from 4 to 5 and x is 1.

13. A method according to claim 12 wherein steps c) to f) are repeated at least once.

14. A method according to claim 12 wherein said surface contains more than 50% of:

noble metals selected from gold, platinum, silver and copper oxidised metals selected from iron, titanium, aluminium, nickel, ruthenium, rhodium, and tin, alloys selected from steel (an alloy of iron and carbon), stainless steel, brass (an alloy of copper and zinc), nickel-silver (an alloy of copper, nickel and zinc), bronze (an alloy of copper and tin), tin-nickel, nickel-phosphorus, copper-beryllium, palladium-nickel, copper-cobalt, or alloys comprising vanadium, chromium, manganese, zinc, tungsten, or zirconium, or an amorphous crystalline structure alloy, or ceramic or glass.

15. A method according to claim 14, wherein the ceramic or glass is ruby (alloy of aluminium oxide and chromium), sapphire (aluminium oxide), zircon, silica or alumina.

16. A method according to claim 14, wherein the semiconductors are silicon (Si) or germanium (Ge) or oxides thereof, or diamond.

17. A method according to claim 14, wherein the surface contains more than 50% of noble metals selected from gold, platinum, silver, and copper or contains more than 50% of alloys selected from steel (alloy of iron and carbon), stainless steel, brass (an alloy of copper and zinc), nickel-silver (an alloy of copper, nickel and zinc), bronze (an alloy of copper and tin), tin-nickel, nickel-phosphorus, copper-beryllium, palladium-nickel, copper-cobalt, or alloys comprising vanadium, chromium, manganese, zinc, tungsten, or zirconium, or an amorphous crystalline structure alloy.

18. A method according to claim 12 wherein the watch or jewellery component is a mechanical piece.

19. A method according to claim 12 wherein the coated surface forms a contact angle with a watch oil of at least 30° to increase the epilame effect on a surface.

20. A method according to claim 19, wherein the contact angle is greater than 40°.

21. A method according to claim 17 wherein said surface contains more than 50% of gold, silver or copper.

22. A method according to claim 12 wherein prior to said contacting step the bisphosphonic compound and thiol compound are dissolved in isopropanol or in a solvent comprising hydrotreated naphthas.

* * * * *